US006540107B1

(12) United States Patent
Admony

(10) Patent No.: US 6,540,107 B1
(45) Date of Patent: Apr. 1, 2003

(54) SELF-DEFENSE RING

(75) Inventor: Merom Admony, Tel Aviv (IL)

(73) Assignee: Ringuard Defense Technologies Ltd., Tel Aviv (IL)

( * ) Notice: Subject to any disclaimer, the term of this patent is extended or adjusted under 35 U.S.C. 154(b) by 0 days.

(21) Appl. No.: 10/046,735

(22) Filed: Jan. 17, 2002

(51) Int. Cl.[7] ..... B67D 17/04

(52) U.S. Cl. ..... 222/78; 222/83; 222/175; 222/402.24

(58) Field of Search ..... 222/78, 83, 153.11, 222/175, 192, 325, 402.1, 402.11, 402.15, 402.24

(56) References Cited

U.S. PATENT DOCUMENTS 2,234,062 A * 3/1941 Roberts ..... 222/83
3,353,749 A 11/1967 Lahaug
4,135,645 A * 1/1979 Kimmell ..... 222/83
4,748,759 A 6/1988 Whiteing
6,123,228 A 9/2000 Hippensteel
6,126,040 A * 10/2000 Hippensteel ..... 222/78
6,135,321 A * 10/2000 Hippensteel ..... 222/78

* cited by examiner

*Primary Examiner*—Henry C. Yuen
*Assistant Examiner*—M A Cartagena
(74) *Attorney, Agent, or Firm*—Mark M. Friedman

(57) ABSTRACT

A self defense ring device which ejects a noxious substance in the direction of an assailant when activated by a user. The invention includes a sealed ampoule containing a noxious substance or a combination of substances separated by membranes. This ampoule is driven forward by pressure within a closed chamber having an ejection outlet. The ampoule is pierced and collapsed by the pressure, ejecting the noxious substance or mixture of substances through the ejection outlet at high speed. This mechanism is appropriate for a wide variety of noxious substances. The ejection outlet is inconspicuously placed on the side or underside of the ring, aiding in concealing the self-defense function of the ring device.

22 Claims, 3 Drawing Sheets

A-A

B-B

SELF-DEFENSE RING

FIELD AND BACKGROUND OF THE INVENTION

The present invention relates to wearable devices for personal protection and defense, and more particularly to rings that discharge a noxious substance towards an assailant when activated by the wearer.

The concept of wearable weaponry for self defense has inspired a number of inventions. Typically, such devices are easily accessed and activated by the user. A further advantage is gained by disguising the weapon as jewelry or a watch, allowing the user to surprise an assailant, and increasing the chance that the user will still have access to the weapon even after being "disarmed" by the assailant.

U.S. Pat. No. 3,353,749 to Lahaug describes a defense ring consisting of a ring with a detachable spray bulb and nozzle which fits into the palm of the user and can be discharged manually by squeezing the bulb. The ring taught by U.S. Pat. No. 3,353,749 is large and unwieldy, such that the device is inappropriate for everyday use. Moreover, the device is susceptible to accidental discharge of the contents of the bulb. Another approach is embodied in U.S. Pat. No. 4,748,759 to Whiteing, which teaches an entire mini-firearm wearable as a ring. A single standard cartridge is manually loaded into the rear of a short barrel, with the back end of the cartridge facing a chamber having a firing pin. When the trigger is released, the barrel and cartridge are propelled towards the firing pin by a spring, and the firing pin contacts the back end of the cartridge with sufficient force to pierce the casing and activate the explosive charge propelling the bullet through the barrel and out on its course. This invention shares certain disadvantages with its progenitor, the handgun. The protruding barrel, which is necessary to provide sufficient bullet travel distance for firing accuracy, is conspicuous. Moreover, the recoil of the weapon will be equal to that of a handgun firing an identical round. This force is now concentrated on the fragile carpal bones of the fingers, thus exposing the user to pain and injury. In addition, the rapid sliding motion of the barrel and cartridge introduces a new vector of force to the weapon at the last instant before firing, skewing the aim.

Returning to patents specifically concerned with the discharge of chemical substances, U.S. Pat. No. 4,135,645 to Kimmel describes a self-defense ring having a mechanism for piercing an ampoule filled with a noxious chemical substance. A major drawback to the weapon as described is the lack of directed propellant force for the chemical substance, which can result in the user being enveloped in the resulting miasma, instead of or in addition to the assailant. Two variations on more directed and controllable release of noxious chemical substances from ring-mounted containers are described in U.S. Pat. Nos. 6,126,040; 6,123,228; and 6,135,321, all to Hippensteel. Upon activation by the user, a safety-equipped trigger mechanism releases a pressurized gas substance through an atomizing aperture in the upper face of the ring. The gas is stored in a reusable canister, which allows for reusability and for multiple firing. The canister is also removable, and can itself be used as a self-defense weapon without the ring housing.

Drawbacks to the self-defense ring as taught by U.S. Pat. Nos. 6,126,040; 6,123,228; and 6,135,321 include the use of a single chemical substance as both propellant and repellant. The chemical substance is held under a pressure of between 60 and 160 p.s.i. in order to provide the physical force to propel the chemical substance towards an assailant. This requirement limits the type of substance which can be used to those which can be safely stored under pressure without corroding the metal, plastic, or rubber components of the canister and release mechanisms. Furthermore, this approach demands exacting tolerances on all components subjected to pressure, since leakage of the noxious substance would be extremely unpleasant or injurious. It also eliminates materials which are solid or liquid at room temperature from being used as repellant. In addition, when the weapon is discharged, the pressure in the canister drops rapidly, diminishing the propellant force, resulting in a portion of the noxious substance remaining in the immediate vicinity of the ring, which is potentially hazardous and/or disabling to the user. A further disadvantage is the placement of the spray atomizer on the upper face of the ring. This disposition forces the user to aim the device by using hand motions that may be perceived as threatening or unnatural by an assailant. This strongly compromises the elements of concealment and surprise that are fundamental to the successful performance of the device in emergency situations.

Thus, there is a clear need for, and it would be quite advantageous to have a self-defense ring which, in addition to overcoming the above-stated disadvantages, is operational using a wide range of repellant substances including binary substances, is inconspicuously aimed and fired, even from a "hands up" position, and propels the entire charge of repellant substance at the assailant and out of the vicinity of the user.

SUMMARY OF THE INVENTION

The invention, a self-defense ring, overcomes the disadvantages described above. There is provided a substance-ejecting ring device, including: (a) a ring for detachable attachment to a finger of a user; (b) a substance-ejecting unit, rigidly attached to the ring, the unit including: (i) a closed collapsible ampoule; (ii) a substance contained within the ampoule, for discharging from the ampoule; (iii) a rigid chamber having an opening, the chamber surrounding the ampoule, and (iv) pressuring means, external to the ampoule, for collapsing the ampoule, wherein the pressuring means acts upon the ampoule so as to discharge the substance from the ampoule, via the chamber, through the opening.

Furthermore, there is provided a alternate embodiment of a substance-ejecting ring device, including: (a) a ring for detachable attachment to a finger of a user; (b) a substance-ejecting unit, rigidly attached to the ring, the unit including: (i) a rigid chamber having an opening; (ii) a first ampoule disposed within the chamber, the ampoule containing a substance for discharging from the ampoule to an environment, via the opening; (iii) a second ampoule, disposed within the chamber, containing a propellant gas, and (iv) triggering means for releasing the propellant gas from the second ampoule into the chamber, wherein, upon demand, the propellant gas acts upon the first ampoule so as to discharge the substance from the first ampoule According to further features in the first preferred embodiment, the ring device includes triggering means for activating the pressuring means on demand.

According to further features in the first preferred embodiment, the pressuring means of the ring device is a pneumatically driven piston.

According to further features in the first preferred embodiment, the triggering means of the ring device includes a valve for releasing compressed propellant gas from a capsule disposed in the chamber, so as to move the piston.

According to further features in the first preferred embodiment, the pressuring means of the ring device is pneumatic pressure within a chamber containing the ampoule and the triggering means is a valve for releasing compressed propellant gas from a capsule contained in the chamber.

According to further features in the first preferred embodiment, the triggering means of the ring device is a lever that initiates a chemical reaction leading to a rapid rise in air pressure within the chamber.

According to further features in the first preferred embodiment, the pressuring means of the ring device is a spring.

According to further features in the above embodiment, the triggering means of the ring device is a lever that is activated to release the spring.

According to further features in the first preferred embodiment, the rigid hollow chamber of the ring device contains means for puncturing the ampoule.

According to further features in the first preferred embodiment, the substance-ejecting unit of the ring device further includes a housing that substantially surrounds the rigid hollow chamber, the chamber and the housing being operatively connected so as to allow for a relative sliding motion of pre-determined length and direction.

According to further features in the first preferred embodiment, the triggering means of the ring device is fixedly attached to the housing.

According to further features in the first preferred embodiment, the substance-ejecting unit of the ring device further includes a safety mechanism attached to the housing, which disables the ejection function on demand.

According to further features in the embodiment with a safety mechanism, the safety mechanism includes a screw which is turned to a position that limits proximity of the housing to the rigid chamber.

According to further features in the first preferred embodiment, the housing of the ring device is fixedly attached to a decorative object.

According to further features in the first preferred embodiment the substance contained in the ampoule of the ring device is substantially harmless, and a mixture composed of the substance and the propellant gas is noxious.

According to further features in the first preferred embodiment, the ampoule of the ring device contains a second collapsible ampoule containing a second substance, and the pressuring means act upon the closed collapsible ampoule to rupture the second collapsible ampoule so as to mix the substances.

According to further features in the preferred embodiment with multiple ampoules, each of the substances contained in the ring device is substantially harmless, and a mixture of the substances is noxious.

According to further features in the first preferred embodiment, the ring includes an ejection outlet disposed opposite the chamber and contains a channel communicating between the chamber and the ejection outlet such that upon demand, the substance is ejected out of the ejection outlet.

According to further features in the alternate preferred embodiment, the first ampoule of the ring device is collapsible, and the propellant gas acts so as to collapse the first ampoule.

According to further features in the alternate preferred embodiment, the ring device includes a piston disposed between the first ampoule and the second ampoule.

According to further features in the alternate preferred embodiment that includes a piston, the triggering means of the ring device includes a valve for releasing the propellant gas from the second ampoule, moving the piston.

The present invention successfully addresses the shortcomings of the presently known configurations by providing a self defense ring with a sealed ampoule that contains the noxious substance. This substance may be gaseous, liquid or powder, and need not be held at high pressure. The action of the firing mechanism is not dependent on keeping dangerous substances sealed at high pressure, but rather on the application of force from outside the sealed ampoule. In embodiments that include a propellant gas, the propellant gas serves to flush the system and mechanism free of the noxious substance and to insure that none of the noxious substance remains in the vicinity of the user. The safety of the invention is further enhanced by the use of binary repellants which are mixed at the moment of ejection to form a noxious substance. In addition, the construction of the ring insures that it appears to be a normal piece of costume jewelry from most viewing angles, with the ejection opening discreetly on the side or the underside of the ring, aiding in camouflaging the defensive nature of the device. In the described embodiment, the noxious substance is sealed behind three layers of solid material, affording greater protection than previous inventions in the case of puncture or damage to the ring device. In addition, the invention provides for a variety of interchangeable combinations of propellant and repellant suited for a variety of expected threats or a variety of local regulations. This same feature enables the use of practice cartridges for training or target practice. Furthermore, each of the individual propellant or repellant components is separately replaceable, affording savings and easier compliance with materials expiration dates.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 2:
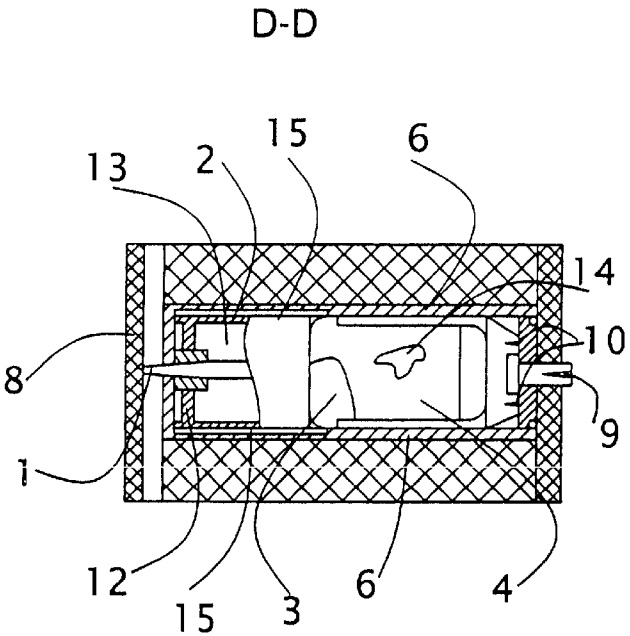
FIG. 2 is a cutaway view from above of a preferred embodiment of the invention.

The present invention is of a self defense ring with separate chambers for propellant and repellant substances. The principles and operation of such a self defense ring according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

Figure 1:
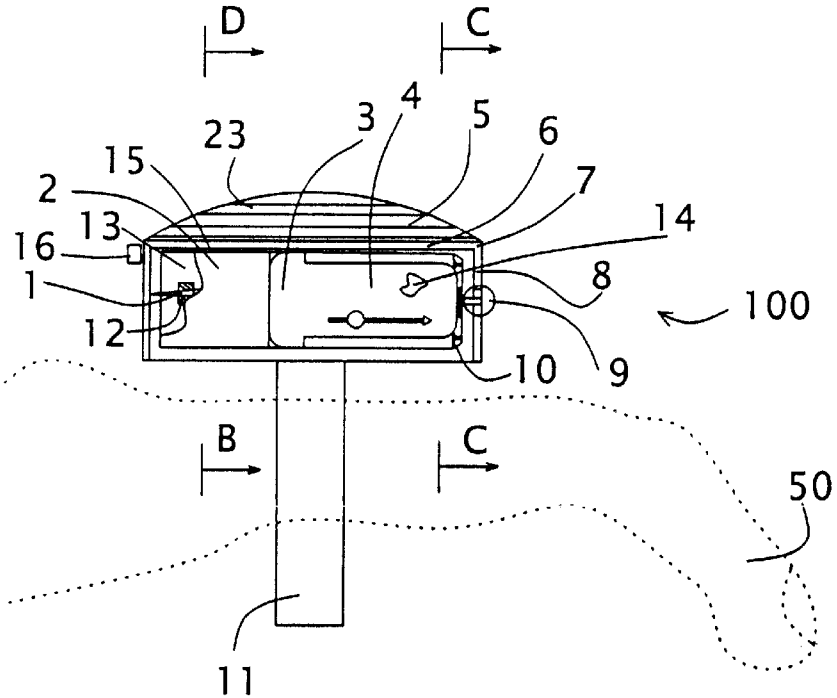
FIG. 1 is a cutaway side view of a preferred embodiment of the invention.

Referring now to the drawings, FIG. 1 shows an embodiment of the invention from the side with a dashed contour 50 indicating the position of the user's finger. A finger ring clasp 11 is fixedly connected to a hollow substantially orthogonal prismatic body 6 containing an ejector outlet 9 disposed in the end face of prismatic body 6 facing the tip of finger 50. Ejector outlet 9 is designed and configured to produce a fine mist, or substantially atomize, substances introduced under pressure. Body 6 accommodates insertion of a repellant cartridge 4 and a propellant cartridge 2 , the cartridges being separated by a cup-shaped piston 3, which, upon the application of sufficient pressure to overcome friction, can slide within body 6, in the direction of the tip of finger 50. Repellant cartridge 4 is made of a substance that is sufficiently plastic to collapse under pressure of piston 3. A housing 8 is slidably mounted on body 6 such that it is free to move along the longitudinal axis of finger 50.

A pin 1 is mounted on an interior face of housing 8, on a side opposite to that of ejector outlet 9. Pin 1 is in alignment with and cooperates with valve 12 in body 6. Housing 8 and body 6 are constructed such that housing 8 is free, upon demand, to move relative to body 6 so as to insert pin 1 into valve 12. This action releases the pressurized propellant gas 13 contained in propellant cartridge 2 into body 6, where it enters channels 15 leading forward towards piston 3. The differential pressure exerted by gas 13 pushes piston 3 forward with force, driving repellant cartridge 4 into pins 10, disposed on the inner forward face of body 6 facing cartridge 4, causing pins 10 to puncture repellant cartridge 4. Piston 3 continues to move forward, crushing repellant cartridge 4 and releasing repellant substance 14 into the extreme front end of body 6 in the vicinity of ejector outlet 9. Repellant substance 14 is forced out of ejector outlet 9 at high speed in the direction of a target. The sequence of actions described above, from the insertion of pin 1 until the directed ejection of repellant substance 14, occurs in a small fraction of a second.

Figure 5A:
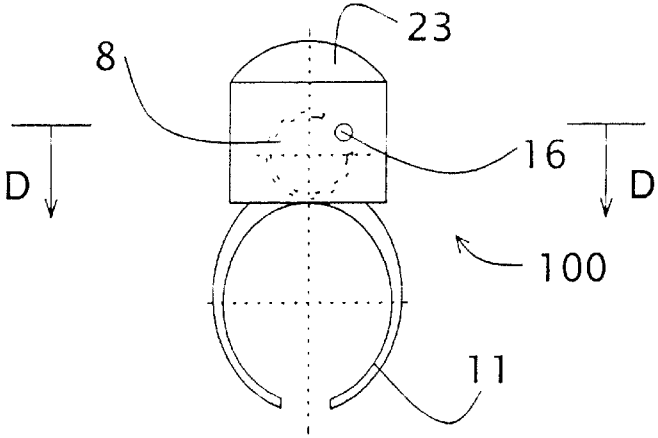
FIGS. 5A and 5B are front and rear views of a preferred embodiment of the invention;.
Figure 5B:
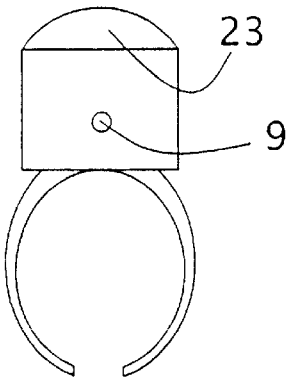
Figure 4:
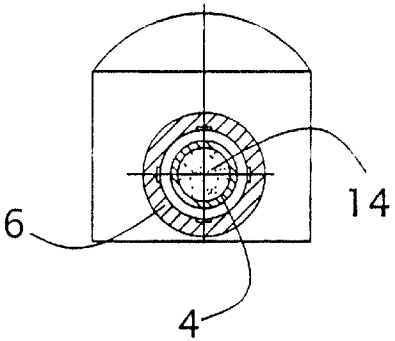
FIG. 4 is a cross section through the forward (repellant) section of a preferred embodiment of the invention.
Figure 3:
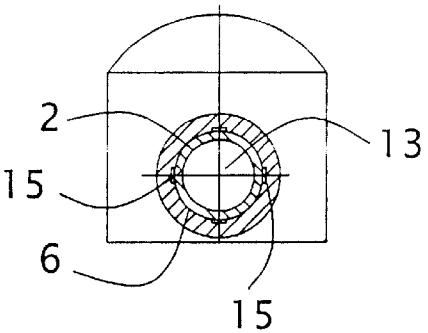
FIG. 3 is a cross section through the rear (propellant) section of a preferred embodiment of the invention.

FIG. 2 shows the same mechanism in a cutaway top view. Visible in this figure are channels 15 that carry propellant gas 13 forward to the center of body 6, releasing gas 13 at the posterior end of piston 3, thus driving piston 3 forward. This construction is better viewed in FIG. 3, in which a cross section of the rear (propellant) portion of body 6 reveals channels 15 within body 6. These channels are engraved only in the rear section of body 6. The cross section in the forward (repellant) portion of body 6, shown in FIG. 4, on the other hand, has no channels for the routing of compressed gas, ensuring a snug, sealed fit between body 6 and piston 3. FIGS. 5A and 5B show rear and front views, respectively, of the substance ejecting ring device 100. The rear view shows a substantially normal looking jeweled ring with a knurled wheel 16 projecting from the back. The front view shows a jeweled ring that substantially appears to be a normal, costume-jewelry type ring, having an inconspicuously small hole corresponding to ejector outlet 9. In both views, decorative object 23 is visible atop the ring.

Figure 6:
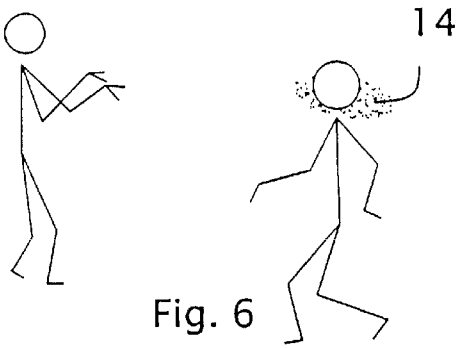
FIG. 6 is a schematic representation of the use of an embodiment of the invention against a potential assailant

FIG. 6 shows the situation a split second after the substance-ejecting ring fires contents 14 at an assailant.

Figure 7:
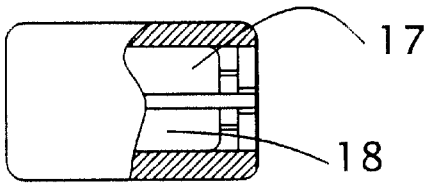
FIG. 7 is a partially cutaway top view of an alternative embodiment of the invention.

FIG. 7 shows a variant of the above described embodiment in which cartridge 4 contains two separate substances in separate ampoules 17 and 18. This alternative accommodates binary irritants in which each substance is essentially harmless, and the resulting mixture is noxious. The force of the propellant is used here to both mix and eject the contents. The safety advantages of such an arrangement are manifest and substantial, in the manufacturing, storage, and installation phases as well as in day to day wearing of the loaded cartridge.

Figure 9:
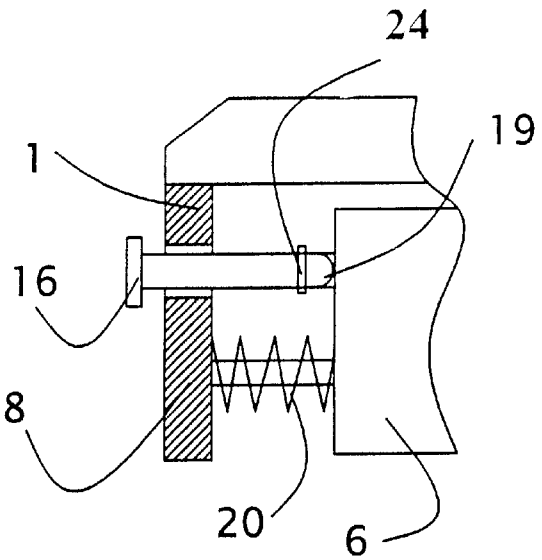
FIG. 9 is an enlarged cross section of the safety mechanism of a preferred embodiment of the invention.
Figure 8:
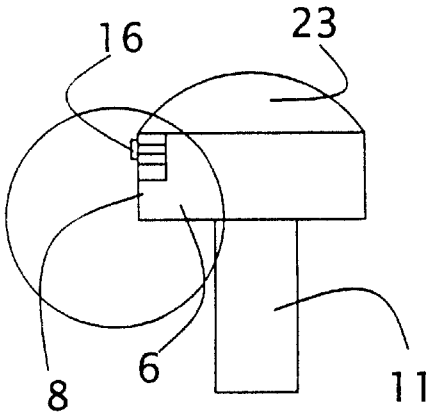
FIG. 8 is a partially cutaway side view of an alternative preferred embodiment of the invention.

FIGS. 8 and 9 show a preferred embodiment in which a safety mechanism prevents an accidental triggering of the ejection mechanism. In FIG. 8, part of the rear section of body 6 is cut away to show a gap between body 6 and housing 8, and knurled screw 16 projecting from the back face of the ring. FIG. 9, an enlarged view of a cross section of the ring at the back face, shows the safety mechanism in greater detail. Knurled screw 16 engages screw threads 17 in the rear face of housing 8, and can thus be set to ensure a minimum gap between body 6 and housing 8. Screw 16 is provided with a flange 18 to prevent screw 16 from being extracted from housing 8, and a bearing projection 19 that engages and biases body 6 in the safety position. When screw 16 is rotated out of contact with body 6, spring 20 remains to flexibly bias housing 8 away from body 6. In this condition, housing 8 can be pushed forward against the resistance of spring 20, triggering the cycle of actions which culminates in ejection of repellant substance 14 as described above.

Figure 11:
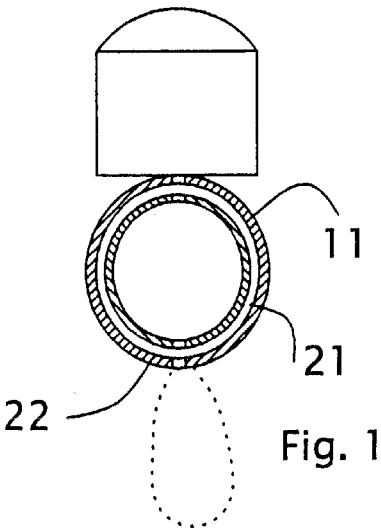
FIG. 11 is a partially cutaway front view of an alternative embodiment of the invention showing a palm-facing discharge of repellant.
Figure 10:
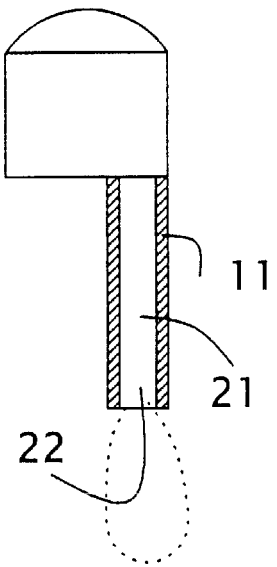
FIG. 10 is a partially cutaway side view of an alternative embodiment of the invention showing a palm-facing discharge of repellant.

FIGS. 10 and 11 illustrate a variation on the above preferred embodiment in which repellant substance 14 is ejected through a channel 21 within a finger ring 11, and is discharged through an ejector outlet 22 on the underside of finger ring 11 near the user's palm. This variation is especially useful in circumstances where the user has his hands up.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A hand-held device for deterring an assailant, the device comprising:

(a) a housing for supporting by a hand of a user, and (b) a substance-ejecting unit, rigidly attached to said housing, said unit including:

(i) a closed collapsible ampoule;

(ii) a substance contained within said ampoule, for discharging from said ampoule;

(iii) a rigid chamber having an opening, said chamber surrounding said ampoule, and (iv) a mechanism including a pneumatically driven piston, said piston disposed externally to said ampoule, for collapsing said ampoule, wherein said mechanism acts upon said ampoule so as to discharge said substance from said ampoule, via said chamber, through said opening.

2. The device of claim 1, further comprising a triggering mechanism for activating said mechanism on demand.

3. The device of claim 2, wherein said triggering mechanism includes a valve for releasing compressed propellant gas from a capsule disposed in said chamber, so as to move said piston.

4. The device of claim 3, wherein said substance is substantially harmless, and a mixture composed of said substance and said propellant gas is noxious.

5. The device of claim 1, wherein said housing includes a ring for detachable attachment to a finger of the user.

6. The device of claim 5, further comprising a triggering mechanism for activating said mechanism on demand.

7. The device of claim 6, wherein said triggering mechanism includes a valve for releasing compressed propellant gas from a capsule contained in said chamber.

8. The device of claim 6, wherein said triggering mechanism includes a lever for initiating a chemical reaction leading to a rapid rise in air pressure within said chamber.

9. The device of claim 5, wherein said ring includes an ejection outlet disposed opposite said chamber and wherein said ring contains a channel communicating between said chamber and said ejection outlet, such that upon demand, said substance is ejected out of said ejection outlet.

10. The device of claim 5, wherein said substance-ejecting unit further includes a second housing that substantially surrounds said rigid hollow chamber, said chamber and said second housing being operatively connected so as to allow for a relative sliding motion of pre-determined length and direction.

11. The device of claim 1, wherein said rigid hollow chamber contains means for puncturing said ampoule.

12. The device of claim 1, wherein said ampoule contains a second collapsible ampoule containing a second substance, and wherein said pressuring means act upon said closed collapsible ampoule to rupture said second collapsible ampoule so as to mix said substances.

13. The device of claim 12, wherein each of said substance and said second substances is substantially harmless, and wherein a mixture of said substance and said second substance is noxious.

14. The device of claim 1, wherein said substance-ejecting unit further includes a safety mechanism attached to said housing, and wherein a triggering means is disabled by said safety mechanism on demand.

15. A hand-held device for deterring an assailant, the device comprising:

(a) a housing for supporting by a hand of a user, and (b) a substance-ejecting unit, rigidly attached to said housing, said unit including:

(i) a rigid chamber having an opening;

(ii) a first ampoule disposed within said chamber, said ampoule containing a substance for discharging from said ampoule to an environment, via said opening;

(iii) a second ampoule, disposed within said chamber, containing a propellant gas, and (iv) triggering means for releasing said propellant gas from said second ampoule into said chamber, wherein upon demand, said propellant gas acts upon said first ampoule so as to discharge said substance from said first ampoule.

16. The device of claim 15, wherein said housing includes a ring for detachable attachment to a finger of the user.

17. The device of claim 15, wherein said first ampoule is collapsible, and wherein said propellant gas acts so as to collapse said first ampoule.

18. The device of claim 17, further comprising a piston disposed between said first ampoule and said second ampoule.

19. The device of claim 18, wherein said triggering means includes a valve for releasing said propellant gas from said second ampoule, so as to move said piston.

20. A hand-held device for deterring an assailant, the device comprising:

(a) a housing for supporting by a hand of a user, and (b) a substance-ejecting unit, rigidly attached to said housing, said unit including:

(i) a closed collapsible ampoule;

(ii) a substance contained within said ampoule, for discharging from said ampoule;

(iii) a rigid chamber having an opening, said chamber surrounding said ampoule, and (iv) a pressuring mechanism, external to said ampoule, for collapsing said ampoule, wherein said pressuring mechanism includes a spring for acting upon said ampoule so as to discharge said substance from said ampoule, via said chamber, through said opening.

21. The device of claim 20, wherein said housing includes a ring for detachable attachment to a finger of the user.

22. The device of claim 21, further comprising triggering means for activating said pressuring mechanism on demand.

* * * * *